United States Patent [19]

Philip, Jr.

[11] Patent Number: 4,578,347

[45] Date of Patent: Mar. 25, 1986

[54] SUPERSENSITIZATION OF SILVER HALIDE EMULSIONS

[75] Inventor: James B. Philip, Jr., St. Paul, Minn.

[73] Assignee: Minnesota Mining and Manufacturing Company, St. Paul, Minn.

[21] Appl. No.: 645,344

[22] Filed: Aug. 29, 1984

[51] Int. Cl.[4] ..... G03C 1/02

[52] U.S. Cl. ..... 430/572; 430/570; 430/576

[58] Field of Search ..... 430/572, 570, 576, 584, 430/601, 610

[56] References Cited

U.S. PATENT DOCUMENTS

| | | | |
|---|---|---|---|
| 3,644,530 | 2/1972 | Bloom et al. | 430/240 |
| 3,695,888 | 10/1972 | Hiller et al. | 96/123 |
| 4,003,746 | 1/1977 | Bigelow | 430/601 |
| 4,346,154 | 8/1982 | McLaen et al. | 430/610 |
| 4,411,985 | 10/1983 | Morrow et al. | 430/610 |

FOREIGN PATENT DOCUMENTS

| | | | |
|---|---|---|---|
| 1066261 | 4/1967 | United Kingdom . | |
| 195872 | 7/1967 | U.S.S.R. | 430/601 |

OTHER PUBLICATIONS

"Effect of Some Phenyl Derivatives of the Elements of the V Group of Periodic Table on the Photographic Properties of Sensitized Emulsions", (1967), M. A. Akhmedzyanov, V. I. Slesareva, M. S. Khaikin and S. A. Lerner.

"Investigation of Some Aryl Phosphines as Activators of Spectral Sensitization", (1969), M. A. Akhmedzyanov, S. A. Lerner, I. P. Sotnikova, A. S. Fakhruidinov and S. G. Fatanyants.

"The Relative Affinities of Co-ordinating Atoms for Silver Ion, Part II Nitrogen, Phosphorus, and Arsenic", Sten Ahrland, J. Chatt, N. R. Davies and A. A. Williams, Journal Chemical Society, 1958.

Chemical Abstracts, p. 410, vol. 94, 1981.

*Primary Examiner*—J. Travis Brown

*Attorney, Agent, or Firm*—Donald M. Sell; James A. Smith; Mark A. Litman

[57] ABSTRACT

The addition of water-soluble triaryl compounds selected from the group consisting of phosphines, amines, arsines, bismuthines and stibylidynes provides sensitizing effects and, when added to spectrally sensitized emulsions, provides a supersensitizing effect. The activity of these compounds is additive with other supersensitizers.

25 Claims, No Drawings

SUPERSENSITIZATION OF SILVER HALIDE EMULSIONS

BACKGROUND OF THE INVENTION

1. Field of the Invention

This invention relates to the use of supersensitizers in photographic emulsions.

2. Background of the Art

In most uses of silver halide in photographic materials, it is desirable to increase the speed or sensitivity of the emulsion. There are a number of different technique for increasing the speed of an emulsion which are usually classified as chemical sensitization or spectral sensitization. Chemical sensitization usually involves modification of the silver halide grains to make the most efficient use of the radiation that they absorb. The three general types of chemical sensitization are sulfur sensitization, reduction sensitization, and precious (noble) metal sensitization. These methods of chemical sensitization are well known and firmly established in the art (e.g., James, T. H. and Vanselow, W. "Chemical Sensitization", J. Photo. Sci. 1, 133 (1953), Freiser, H. and Ranz, E., Ber der Bunsengesellschaft, 68, 389 (1964), and Pouradier, J. "Chemical Sensitization", Photographic Theory: Liege Summer School, A. Hautot, p. 111, Focal Press (London) 1963).

Spectral sensitization enables grains to benefit from radiation in regions of the electromagnetic spectrum where the silver halide would ordinarily not absorb. Dyes which absorb radiation and can transfer energy to the grains to help in the photoreduction of silver ions to clusters of silver metal are conventionally used to effect spectral sensitization.

Another phenomonon associated with the use of spectral sensitizing dyes is known in the art as supersensitization. The addition of small amounts of other substances, frequently in quantities of about one percent of the molar amount of the dye, can increase the spectrally sensitized speed of the emulsion by more than an order of magnitude. Some supersensitizers are dyes themselves, but many others do not absorb radiation in significant amounts in the visible portion of the electromagnetic spectrum. Therefore, the effect of supersensitizers on spectral sensitization is not clearly dependent on the ability of compounds to absorb radiation in the visible portion of the spectrum. Certain cyanines, merocyanines compounds analogous to cyanines, certain acylmethylene derivatives of heterocyclic bases, and ketone derivatives such as p-dimethylaminobenzalacetone are known supersensitizers. Not all supersensitizers work with all spectral sensitizers. There is no general knowledge in the art that supersensitizers are capable of sensitization in the absence of spectral sensitizers. An expanded selection of supersensitizers is therefore desired.

Triphenylphosphine, $P(C_6H_5)_3$ (hereinafter TPP), is reported in the literature as a supersensitizer for infrared sensitive silver halide emulsion using certain spectral sensitizing dyes (Zhurnel Nauchnio i Prikladnoi Fotografi i Kinematograffi 14 (2) 148–149 (1969) and 12 (6), 462–463 (1967), M. A. Akhmedzyanov et al. and Zh. Prikl. Spektrosk., 1980, 33 (3), 557–56 M. I. Demchuk et al.). The use of triphenylphosphine presents a number of problems because it is insoluble in water and causes dramatic variations in infrared sensitivity over moderate periods of time during coating operations.

BRIEF DESCRIPTION OF THE INVENTION

Water-soluble derivatives of triaryl phosphides, amines, arsenides, antimonides and bismuthides have been found to act as supersensitizers to spectrally sensitized and especially infrared spectrally sensitized silver halide emulsions and also to act as sensitizers for silver halide emulsions without spectral sensitizers.

These water-soluble supersensitizers have been found to be particularly effective in combination with other photographic adjuvants such as phenylmercaptotetrazole, poly(ethylacrylate) and the supersensitizer leucophor BCF.

DETAILED DESCRIPTION OF THE INVENTION

Triaryl phosphides, arsensides, antimonides, and bismuthides wherein at least one aryl group has a substituent which renders the compound water-soluble are supersensitizers for spectrally sensitized and especially infrared spectrally sensitized silver halide emulsions. These compounds are also sensitizers for silver halide emulsions which are not spectrally sensitized. The supersensitizing compounds of the present invention may be generally represented by the formula:

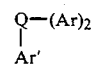

wherein

Q is selected from N, P, As, Sb and Bi,

Ar is an aryl group, and

Ar′ is an aryl group having a substituent thereon which renders the compound water-soluble.

Any aryl group, Ar, may be used in the practice of the present invention as long as the compound is water-soluble. The aryl group may be phenyl, naphthyl, thienyl, furanyl and pyrazolyl, for example. The aryl group, Ar, may be substituted or unsubstituted. The same substituents used on the aryl group, Ar′, may be used or other substituents which do not prevent the compound from being water-soluble may be used. In addition to the substituents listed for Ar′, such substituents as halogen (—Br, —Cl), nitro ($—NO_2$), alcohols ($—CH_2OH$), ethers ($—CH_2OCH_3$), amines ($—N(alkyl)_2$), low molecular weight alkyls ($CH_3$, $CH_2CH_3$) and the like may be used.

The aryl group, Ar′, must bear at least one water-solubilizing substituent. Examples of highly efficient water-solubilizing substituents are sulfonates (with an associated cation such as alkali metal cations), sulfonic acid, sulfonic acid ester, carboxylate, carboxylic acid, carboxylic esters, alcohols (particularly low molecular weight alcohols of 1–3 carbons), phosphate, phosphite, phophines, and nitro-compounds (i.e., $—NO_2$). The strongly acidic members of that group are particularly preferred. Ar′ may also be additionally substituted by groups that do not contribute positively to the water-solubility of the compounds, and more than one solubilizing group may be present on Ar′.

Examples of compounds of the present invention which are reported in the literature and/or commercially available include the following:

p-(Diphenylphosphino)benzoic acid

Sodium diphenylphosphinobenzene-m-sulfonate

Trisodium salt of tri-(m-sulfophenyl)arsine (trisodium triphenylarsine-m,m′,m″-trisulfonate)

Tri-(m-[sulfonic acid]phenyl)arsine
Tri-(p-[methyl ester sulfonic acid]-phenyl)phosphine
m-(Diphenylphosphino)benzoic acid
(p-Carbomethoxyphenyl)diphenylphosphine
o-(Diphenylphosphino)benzoic acid
3,3'-(Phenylphosphinidene)di-benzoic acid 4,4'-(Phenylphosphinidene)di-benzoic acid
2,2',2''-(Arsylidyne)tri-benzoic acid
4,4',4''-Phosphinidynetris-benzoic acid
3,3',3''-Phosphinidynetri-benzoic acid
2-(Diphenylarsino)benzoic acid
p-(Diphenylarsino)benzoic acid
p-(Diphenylarsino)methyl ester benzoic acid
3,3',3''-(Arsylidyne)tri-benzoic acid
4,4',4''-Stibylidynetris-benzoic acid
p-(Diphenylstibylidyne)benzoic acid
p-(Diphenylstibylidyne)sulfonic acid sodium salt
4,4',4''-Phosphinidynetris-benzoic acid trimethyl ester
2-(Diphenylamino)-5-methyl-1,3-benzenedicarboxylic acid
2-[(2-Aminophenyl)phenylamino]benzoic acid
2-[(2-Nitrophenyl)phenylamino]benzoic acid
2-(Diphenylamino)benzoic acid
2-[(2,5-Dichlorophenyl)phenylamino]benzoic acid
2-[Bis(4-methylphenyl)arsino]benzoic acid
2,2',2''-Nitrilotris-benzene methanol triacetate
p-(Diphenylbismuthine)benzoic acid
2,2'-(Phenylbismuthine)dibenzoic acid
3,3',3''-Bismuthine-tris-benzoic acid
3,3',3''-Bismuthine-tris-sulfonic acid tri-sodium salt The term "water-soluble" as used in the practice of the present invention indicates that the compound is soluble in an amount of at least 0.5 g/liter. Preferably the compound is soluble in an amount of at least 1 g/liter.

These type of compounds are added to the optically sensitized emulsions in any of the conventional methods by which supersensitizers or other adjuvants are added to photographic emulsions. Typically the water-soluble supersensitizing compounds of the present invention are added into the emulsion mixture just prior to coating, mixed well, then coated onto the photographic substrate. The compounds are added as aqueous solutions, alone, or with other desirable adjuvants.

The compounds of the present invention may be added in any effective supersentizing amount to the photographic emulsion. The concentration of ingredients and materials can vary significantly in photographic emulsions such as from 0.5 to 10 g/m$^2$ for silver. The supersensitizers may also vary significantly in concentration. A generally useful range would be from 0.001 to 0.5 percent by dry weight of the total silver halide emulsion layer. This would generally comprise about 0.01 to 50% by weight of the silver halide in the photographic emulsion layer. A more preferred range would be from 0.1 to 3% by weight of the silver halide or about 0.01 to 0.3% total dry weight of the coated emulsion layer.

Any spectral sensitizing dye and any infrared spectral sensitizing dye may be used in the practice of the present invention with the water-soluble supersensitizing compounds of the present invention. Useful dyes for this purpose tend to be merocyanies, cyanines and especially tricarbocyanines. Such dye sensitizers for the infrared are described for example in U.S. Pat. Nos. 3,619,154, 3,682,630, 3,690,891, 3,695,888, 4,030,932 and 4,367,800. The preferred classes of compounds are the tricarbocyanines such as the 3,3'-dialkylthiatricarbocyanines, thiatricarbocyanines (especially with rigidized chains), selenotricarbocyanies, and enamine tricarbocyanines.

Silver halide emulsions supersensitized in accordance with this invention can comprise silver chloride, silver bromide, silver bromoiodide, silver chloroiodide, silver chlorobromoiodide or mixtures thereof. Such emulsions can be coarse, medium or fine grain (or mixtures thereof) and can be prepared by any of the well-known procedures, e.g., single jet emulsions or double jet emulsions. Useful emulsions include Lippmann emulsions, ammoniacal emulsions, thiocyanate or thioether ripened emulsions such as those described in Nietz et al., U.S. Pat. No. 2,222,264, Illingsworth, U.S. Pat. No. 3,320,069, and McBride, U.S. Pat. No. 3,271,157; or, cubic grain emulsions, such as those described by Kline and Moisar, Journal of Photographic Science, volume 12, page 242 et seq. or Markocki, The Spectral Sensitization of Silver Bromide Emulsions on Different Crystallographic Faces, Journal of Photographic Science, volume 13, 1965; or Illingsworth, British Pat. No. 1,156,193 published June 25, 1969.

Tabular or lamellar grain emulsions as described in U.S. Pat. Nos. 4,425,425 and 4,425,426 are also equally useful.

The silver halide emulsions supersensitized with the dyes of this invention can be unwashed or washed to remove soluble salts. In the latter case the soluble salts can be removed by chill-setting and leaching or the emulsion can be coagulation washed e.g., by the procedures described in Hewitson et al., U.S. Pat. No. 2,618,556; Yutzy et al., U.S. Pat. No. 2,614,928; Yackel, U.S. Pat. No. 2,565,418; Hart et al., U.S. Pat. No. 3,241,969; and Waller et al., U.S. Pat. No. 2,489,341.

Photographic emulsions containing supersensitizing combinations in accordance with this invention can be sensitized with chemical sensitizers, such as with reducing agents; sulfur, selenium or tellurium compounds; gold, platinum or palladium compounds; or combinations of these. Suitable chemical sensitization procedures are described in Shepard, U.S. Pat. No. 1,623,499; Waller, U.S. Pat. No. 2,399,083; McVeigh, U.S. Pat. No. 3,297,447; and Dunn, U.S. Pat. No. 3,297,446.

The supersensitized silver halide emulsions of this invention can contain speed increasing compounds such as polyalkylene glycols, cationic surface active agents and thioethers or combinations of these as described in Piper, U.S. Pat. No. 2,886,437; Chechak, U.S. Pat. No. 3,046,134; Carroll et al., U.S. Pat. No. 2,944,900; and Goffe, U.S. Pat. No. 3,294,540.

Silver halide emulsions containing the supersensitizing combinations of this invention can be protected against the production of fog and can be stabilized against loss of sensitivity during keeping. Suitable antifoggants and stabilizers which can be used alone or in combination, include the thiazolium salts described in Staud, U.S. Pat. No. 2,131,038 and Allen, U.S. Pat. No. 2,694,716; the azaindenes described in Piper, U.S. Pat. No. 2,886,437 and Heimbach, U.S. Pat. No. 2,444,605; the mercury salts described in Allen, U.S. Pat. No. 2,728,663; the urazoles described in Anderson, U.S. Pat. No. 3,287,135; the sulfocatechols described in Kennard, U.S. Pat. No. 3,235,652; the oximes described in Carroll et al, British Pat. No. 623,448; nitron, nitroindazoles; the mercaptotetrazoles described in Kendall et al., U.S. Pat. No. 2,403,927, Kennard et al., U.S. Pat. No. 3,266,897 and Luckey et al., U.S. Pat. No. 3,397,987; the polyvalent metal salts described in Jones, U.S. Pat. No.

2,839,405; the thiuronium salts described in Herz, U.S. Pat. No. 3,220,839; and the palladium, platinum and gold salts described in Trivelli, U.S. Pat. No. 2,566,263 and Damschroder, U.S. Pat. No. 2,597,915.

Photographic elements including emulsions supersensitized in accordance with this invention can contain incorporated developing agents such as hydroquinones, catechols, aminophenols, 3-pyrazolidones, ascorbic acid and its derivatives, reductones and phenylenediamines, or combinations of developing agents. The developing agents can be in the silver halide emulsion and/or in another suitable location in the photographic element. The developing agents can be added from suitable solvents or in the form of dispersions as described in Yackel, U.S. Pat. No. 2,592,368 and Dunn et al., French Pat. No. 1,505,778.

Silver halide supersensitized in accordance with the invention can be dispersed in colloids that can be hardened by various organic or inorganic hardeners, alone or in combination, such as the aldehydes, and blocked aldehydes, ketones, carboxylic and carbonic acid derivatives, sulfonate esters, sulfonyl halides and vinyl sulfones, active halogen compounds, epoxy compounds, aziridines, active olefins, isocyanates, carbodiimides, mixed function hardeners and polymeric hardeners such as oxidized polysaccharides, e.g., dialdehyde starch, oxyguargum, etc.

Photographic emulsions supersensitized with the materials described herein can contain various colloids alone or in combination as vehicles or binding agents. Suitable hydrophilic materials include both naturally-occurring substances such as proteins, for example, gelatin, gelatin derivatives, (e.g., phthalated gelatin), cellulose derivatives, polysaccharides such as dextran, gum arabic and the like; and synthetic polymeric substances such as water soluble polyvinyl compounds, e.g., poly(vinylpyrrolidone)acrylamide polymers or other synthetic polymeric compounds such as dispersed vinyl compounds in latex form, and particularly those which increase the dimensional stability of the photographic materials. Suitable synthetic polymers include those described, for example, in U.S. Pat. Nos. 3,142,568 of Nottorf; 3,193,386 of White; 3,062,674 of Houck, Smith and Yudelson; 3,220,844 of Houck, Smith and Yudelson; Ream and Fowler, 3,287,289; and Dykstra, U.S. Pat. No. 3,411,911; particularly effective are those water-insoluble polymers of alkyl acrylates and methacrylates, acrylic acid, sulfoalkyl acrylates or methacrylates, those which have cross linking sites which facilitate hardening or curing and those having recurring sulfobentaine units as described in Canadian Pat. No. 774,054.

Emulsions supersensitized in accordance with this invention can be used in photographic elements which contain antistatic or conducting layers, such as layers that comprise soluble salts, e.g., chlorides, nitrates, etc., evaporated metal layers, ionic polymers such as those described in Minsk, U.S. Pat. Nos. 2,861,056 and 3,206,312 or insoluble inorganic salts such as those described in Trevoy, U.S. Pat. No. 3,428,451.

Photographic emulsions containing the supersensitizing combinations of the invention can be coated on a wide variety of supports. Typical supports include polyester film, subbed polyester film, poly(ethylene terephthalate) film, cellulose nitrate film, cellulose ester film, poly(vinyl acetal) film, polycarbonate film and related films or resinous materials, as well as glass, paper, metal and the like. Typically, a flexible support is employed, especially a paper support, which can be partially acetylated or coated with baryta and/or an alpha-olefin polymer, particularly a polymer of an alpha-olefin containing 2 to 10 carbon atoms such as polyethylene, polypropylene, ethylenebutene copolymers and the like.

Supersensitized emulsions of the invention can contain plasticizers and lubricants such as polyalcohols, e.g., glycerin and diols of the type described in Milton, U.S. Pat. No. 2,960,404; fatty acids or esters such as those described in Robijns, U.S. Pat. No. 2,588,765 and Duane, U.S. Pat. No. 3,121,060; and silicone resins such as those described in DuPont British Pat. No. 955,061.

The photographic emulsions supersensitized as described herein can contain surfactants such as saponin, anionic compounds such as the alkylarylsulfonates described in Baldsiefen, U.S. Pat. No. 2,600,831 fluorinated surfactants, and amphoteric compounds such as those described in Ben-Ezra, U.S. Pat. No. 3,133,816.

Photographic elements containing emulsion layers sensitized as described herein can contain matting agents such as starch, titanium dioxide, zinc oxide, silica, polymeric beads including beads of the type described in Jelley et al, U.S. Pat. No. 2,992,101 and Lynn, U.S. Pat. No. 2,701,245.

Spectrally sensitized emulsions of the invention can be utilized in photographic elements which contain brightening agents including stilbene, triazine, oxazole and coumarin brightening agents. Water soluble brightening agents can be used such as those described in Albers et al., German Pat. No. 972,067 and McFall et al., U.S. Pat. No. 2,933,390 or dispersions of brighteners can be used such as those described in Jansen, German Pat. No. 1,150,274 and Oetiker et al., U.S. Pat. No. 3,406,070.

Photographic elements containing emulsion layers supersensitized according to the present invention can be used in photographic elements which contain light absorbing materials and filter dyes such as those described in Sawdey, U.S. Pat. No. 3,253,921; Gaspar, U.S. Pat. No. 2,274,782; Carrol et al., U.S. Pat. No. 2,527,583 and Van Campen, U.S. Pat. No. 2,956,879. If desired, the dyes can be mordanted, for example, as described in Milton and Jones, U.S. Pat. No. 3,282,699.

The sensitizing dyes and/or supersensitizers (and other emulsion addenda) can be added to the photographic emulsions from water solution or suitable organic solvent solutions, for example with the procedure described in Collins et al., U.S. Pat. No. 2,912,343; Owens et al., U.S. Pat. No. 3,342,605; Audran, U.S. Pat. No. 2,996,287 or Johnson et al., U.S. Pat. No. 3,425,835. The dyes can be dissolved separately or together, and the separate or combined solutions can be added to a silver halide emulsion, or a silver halide emulsion layer can be bathed in the solution of supersensitizers and/or dyes.

Contrast enhancing additives such as hydrazines, rhodium, irridium and combinations thereof are also useful.

Photographic emulsions of this invention can be coated by various coating procedures including dip coating, air knife coating, curtain coating, or extrusion coating using hoppers of the type described in Beguin, U.S. Pat. No. 2,681,294. If desired, two or more layers may be coated simultaneously by the procedures described in Russell, U.S. Pat. No. 2,761,791 and Wynn British Pat. No. 837,095.

Silver halide emulsions containing the supersensitizer combinations of this invention can be used in elements designed for color photography, for example, elements containing color-forming couplers such as those described in Frolich et al., U.S. Pat. No. 2,376,679; Vittum et al., U.S. Pat. No. 2,322,027; Fierke et al., U.S. Pat. No. 2,801,171; Godowsky, U.S. Pat. No. 2,698,794; Barr et al., U.S. Pat. No. 3,227,554 and Graham, U.S. Pat. No. 3,046,129; or elements to be developed in solutions containing color-forming couplers such as those described in Mannes and Godowsky, U.S. Pat. No. 2,252,718; Carroll et al. U.S. Pat. No. 2,592,243 and Schwan, U.S. Pat. No. 2,950,970.

Exposed photographic emulsions of this invention can be processed by various methods including processing in alkaline solutions containing conventional developing agents such as hydroquinones, catechols, aminophenols, 3-pyrazolidones, phenylenediamines, ascorbic acid derivatives, hydroxylamines, hydrazines and the like; web processing such as described in Tegillus et al., U.S. Pat. No. 3,179,517; stabilization processing as described in Yackel et al. "Stabilization Processing of Films and Papers", PSA Journal, vol. 16B, August 1950; monobath processing as described in Levy "Combined Development and fixation of Photographic Images with Monobaths", Phot, Sci. and Eng., vol. 2, No. 3, October 1958, and Barnes et al. U.S. Pat. No. 3,392,019. If desired, the photographic emulsions of this invention can be processed in hardening developers such as those described in Allen et al., U.S. Pat. No. 3,232,761; in roller transport processors such as those described in Russel, U.S. Pat. No. 3,025,779; or by surface application processing as described in Example 3, of Kitze, U.S. Pat. No. 3,418,132.

Particularly useful additives in the practice of the present invention which are effectively combined with the water-soluble supersensitizing compounds are poly-(ethyl acrylate), phenylmercaptotetrazole and Leucophor BCF (hereinafter PEA, PMT and BCF, respectively).

These and other aspects of the invention will be shown by the Examples.

Two different emulsions are used in the various examples to show the practice of the present invention. Emulsion A was prepared by a double jet precipitation to provide an emulsion with 64% chloride and 36% bromide with an average grain size of 0.24 micrometers. The emulsion was divided in half for two different types of chemical sensitization. Emulsion Aa was digested with sodium thiosulfate while Ab was digested with p-toluenesulfinic acid, sodium thiosulfate and sodium gold tetrachloride ($NaAuCl_4$).

Final preparation of the emulsions comprised the addition of water and gelatin to a level of 5.0% gelatin and 2500 g of emulsion per mole of silver. The pH was adjusted to 7.0, and the pAg was adjusted to 7.2. Infrared sensitizing dyes were added as 0.04% by weight solutions in methanol. PMT was added as a 0.1% methanol solution and PEA as a 20% aqueous solution. The water-soluble supersensitizer, formaldehyde hardener and any other indicated materials were added before coating as an aqueous solution.

EXAMPLES 1-20

The effect of various individual and combinations of additives on photographic silver halide emulsions were investigated. Emulsion Ab was dyed with the infrared sensitizing dye shown below, and diphenylphosphinobenzene-m-sulfonate sodium salt (DBS) was the water-soluble compound. The coated and dried film was aged one week before exposing on a sensitometer for $10^{-3}$ seconds through a Huoy cut-off filter which filtered out all radiation below 760 nm. The exposed films were developed in a 90 second Xray processor. Sensitometric measurements include $D_{min}$, $D_{max}$, speed (at O.D.=0.25), average contrast ($\bar{C}$), change in speed from emulsion without additives (dS), and the percent that change (ds) represented (% dS). The measurements were taken on the photographic element when freshly dried and on a sample incubated for three days at 50° C. and 40% R.H. The amounts of PMT, DBS, BCF and PEA are presented in grams per mole of silver. The results are shown in Table I for emulsion Ab.

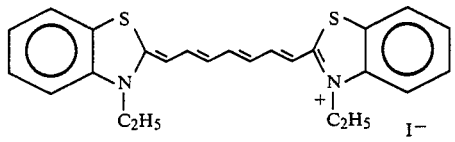

TABLE I

| | | | | | Fresh | | | | | | Incubated | | | | |
|---|---|---|---|---|---|---|---|---|---|---|---|---|---|---|---|
| Ex | PMT | DBS | BCF | PEA | Dmin | Dmax | S | $\bar{C}$ | dS | % dS | Dmin | Dmax | S | $\bar{C}$ | −dS |
| 1 | 0 | 0 | 0 | 0 | 0.03 | 3.25 | 1.17 | 3.26 | — | 100 | 0.04 | 3.18 | 1.13 | 3.10 | 0.04 |
| 2 | 0.038 | 0 | 0 | 0 | 0.03 | 3.30 | 1.40 | 3.23 | 0.23 | 170 | 0.04 | 3.22 | 1.13 | 3.12 | 0.27 |
| 3 | 0 | 0.28 | 0 | 0 | 0.03 | 3.28 | 1.45 | 2.86 | 0.28 | 190 | 0.04 | 3.24 | 1.39 | 2.71 | 0.06 |
| 4 | 0 | 0 | 0.50 | 0 | 0.04 | 3.32 | 2.01 | 3.13 | 0.84 | 692 | 0.05 | 3.25 | 1.96 | 3.01 | 0.05 |
| 5 | 0 | 0 | 0 | 30 | 0.03 | 3.17 | 1.36 | 3.31 | 0.19 | 155 | 0.04 | 3.14 | 1.32 | 3.14 | 0.04 |
| 6 | 0.038 | 0.28 | 0 | 0 | 0.03 | 3.20 | 1.38 | 2.82 | 0.21 | 162 | 0.04 | 3.18 | 1.27 | 2.75 | 0.11 |
| 7 | 0.038 | 0 | 0.50 | 0 | 0.04 | 3.41 | 1.91 | 3.20 | 0.74 | 550 | 0.04 | 3.17 | 1.71 | 3.03 | 0.20 |
| 8 | 0.038 | 0 | 0 | 30 | 0.03 | 3.25 | 1.66 | 3.21 | 0.49 | 309 | 0.04 | 3.21 | 1.39 | 3.13 | 0.27 |
| 9 | 0 | 0.28 | 0.50 | 0 | 0.04 | 3.28 | 1.94 | 2.83 | 0.77 | 589 | 0.05 | 3.22 | 1.85 | 2.73 | 0.09 |
| 10 | 0 | 0.28 | 0 | 30 | 0.03 | 3.17 | 1.58 | 2.80 | 0.41 | 257 | 0.04 | 3.16 | 1.52 | 2.71 | 0.06 |
| 11 | 0 | 0 | 0.50 | 30 | 0.03 | 3.38 | 2.07 | 3.20 | 0.90 | 794 | 0.04 | 3.19 | 2.02 | 2.98 | 0.05 |
| 12 | 0.038 | 0.28 | 0.50 | 0 | 0.03 | 3.31 | 1.86 | 2.84 | 0.69 | 490 | 0.04 | 3.20 | 1.77 | 2.76 | 0.09 |
| 13 | 0.038 | 0.28 | 0 | 30 | 0.03 | 3.15 | 1.60 | 2.77 | 0.43 | 269 | 0.04 | 3.12 | 1.50 | 2.71 | 0.10 |
| 14 | 0.038 | 0 | 0.50 | 30 | 0.03 | 3.20 | 2.10 | 3.18 | 0.91 | 851 | 0.04 | 3.07 | 1.99 | 2.99 | 0.11 |
| 15 | 0 | 0.28 | 0.50 | 30 | 0.03 | 3.24 | 2.00 | 2.86 | 0.83 | 676 | 0.04 | 3.04 | 1.92 | 2.61 | 0.08 |
| 16 | 0.038 | 0.28 | 0.50 | 30 | 0.03 | 3.12 | 1.97 | 2.74 | 0.80 | 631 | 0.04 | 3.13 | 1.92 | 2.66 | 0.05 |
| 17 | 0.019 | 0.14 | 0.25 | 15 | 0.03 | 3.24 | 1.96 | 2.99 | 0.79 | 617 | 0.04 | 3.15 | 1.86 | 2.86 | 0.10 |
| 18 | 0.019 | 0.14 | 0.25 | 15 | 0.04 | 3.21 | 1.96 | 2.95 | 0.79 | 617 | 0.04 | 3.20 | 1.88 | 2.84 | 0.08 |
| 19 | 0.019 | 0.14 | 0.25 | 15 | 0.03 | 3.15 | 1.96 | 2.90 | 0.79 | 617 | 0.04 | 3.16 | 1.87 | 2.85 | 0.09 |
| 20 | 0.019 | 0.14 | 0.25 | 15 | 0.03 | 3.24 | 1.96 | 2.96 | 0.79 | 617 | 0.04 | 3.12 | 1.87 | 2.82 | 0.09 |

The data show that DBS is an efficient supersensitizer. DBS works very effectively in combination with each and every additive of phenylmercaptotetrazole, poly(ethylacrylate), and Leucophor BCF.

EXAMPLES 21–40

Examples 1–20 were repeated on emulsion Ab except that the infrared spectral sensitizing dye:

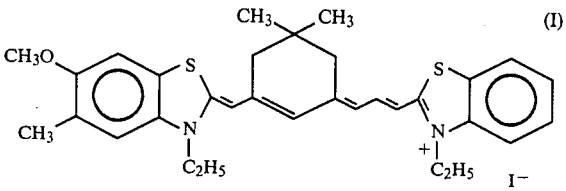

(I)

was used. The results are reported in Table II.

TABLE II

| Ex | PMT | DBS | BCF | PEA | Dmin | Dmax | S | $\bar{C}$ | dS | % dS | Incubated Dmin | Dmax | S | $\bar{C}$ | −dS |
|---|---|---|---|---|---|---|---|---|---|---|---|---|---|---|---|
| 21 | 0 | 0 | 0 | 0 | 0.04 | 3.31 | 1.41 | 3.19 | — | 100 | 0.05 | 3.27 | 1.39 | 3.03 | 0.02 |
| 22 | 0.038 | 0 | 0 | 0 | 0.04 | 3.38 | 1.80 | 3.22 | 0.39 | 245 | 0.05 | 3.27 | 1.68 | 2.90 | 0.12 |
| 23 | 0 | 0.28 | 0 | 0 | 0.04 | 3.36 | 1.65 | 2.87 | 0.24 | 174 | 0.05 | 3.27 | 1.54 | 2.66 | 0.11 |
| 24 | 0 | 0 | 0.50 | 0 | 0.04 | 3.38 | 1.67 | 3.17 | 0.26 | 182 | 0.05 | 3.25 | 1.54 | 2.89 | 0.13 |
| 25 | 0 | 0 | 0 | 30 | 0.04 | 3.31 | 1.55 | 3.18 | 0.14 | 138 | 0.05 | 3.21 | 1.52 | 2.93 | 0.03 |
| 26 | 0.038 | 0.28 | 0 | 0 | 0.04 | 3.35 | 1.73 | 2.88 | 0.32 | 209 | 0.05 | 3.22 | 1.63 | 2.76 | 0.10 |
| 27 | 0.038 | 0 | 0.50 | 0 | 0.04 | 3.38 | 1.76 | 3.16 | 0.36 | 229 | 0.05 | 3.31 | 1.64 | 2.96 | 0.12 |
| 28 | 0.038 | 0 | 0 | 30 | 0.04 | 3.40 | 1.86 | 3.29 | 0.45 | 282 | 0.05 | 2.09 | 1.73 | 2.89 | 0.13 |
| 29 | 0 | 0.28 | 0.50 | 0 | 0.04 | 3.37 | 1.84 | 2.93 | 0.43 | 269 | 0.05 | 3.31 | 1.73 | 2.76 | 0.11 |
| 30 | 0 | 0.28 | 0 | 30 | 0.04 | 3.27 | 1.80 | 2.90 | 0.39 | 245 | 0.05 | 3.16 | 1.74 | 2.75 | 0.06 |
| 31 | 0 | 0 | 0.50 | 30 | 0.04 | 3.20 | 1.90 | 3.07 | 0.49 | 309 | 0.05 | 3.22 | 1.84 | 2.96 | 0.06 |
| 32 | 0.038 | 0.28 | 0.50 | 0 | 0.04 | 3.44 | 1.83 | 2.98 | 0.42 | 263 | 0.05 | 3.38 | 1.73 | 2.78 | 0.10 |
| 33 | 0.038 | 0.28 | 0 | 30 | 0.04 | 3.40 | 1.86 | 2.92 | 0.45 | 282 | 0.05 | 3.24 | 1.79 | 2.70 | 0.07 |
| 34 | 0.038 | 0 | 0.50 | 30 | 0.04 | 3.33 | 1.96 | 3.16 | 0.55 | 355 | 0.05 | 3.17 | 1.88 | 2.98 | 0.08 |
| 35 | 0 | 0.28 | 0.50 | 30 | 0.04 | 3.19 | 1.97 | 2.83 | 0.56 | 363 | 0.05 | 3.19 | 1.92 | 2.72 | 0.05 |
| 36 | 0.038 | 0.28 | 0.50 | 30 | 0.04 | 3.28 | 1.98 | 2.84 | 0.57 | 372 | 0.04 | 3.15 | 1.90 | 2.66 | 0.08 |
| 37 | 0.019 | 0.14 | 0.25 | 15 | 0.04 | 3.18 | 1.86 | 2.95 | 0.45 | 282 | 0.05 | 3.24 | 1.78 | 2.87 | 0.08 |
| 38 | 0.019 | 0.14 | 0.25 | 15 | 0.04 | 3.37 | 1.87 | 3.07 | 0.46 | 288 | 0.04 | 3.20 | 1.76 | 2.84 | 0.11 |
| 39 | 0.019 | 0.14 | 0.25 | 15 | 0.04 | 3.38 | 1.87 | 3.11 | 0.46 | 288 | 0.05 | 3.25 | 1.77 | 2.88 | 0.10 |
| 40 | 0.019 | 0.14 | 0.25 | 15 | 0.04 | 3.31 | 1.88 | 3.06 | 0.47 | 295 | 0.05 | 3.31 | 1.77 | 2.91 | 0.11 |

EXAMPLES 41–60

Examples 21–40 were repeated except that Emulsion Aa was used with the same infrared sensitizing dye. The results are reported in Table III.

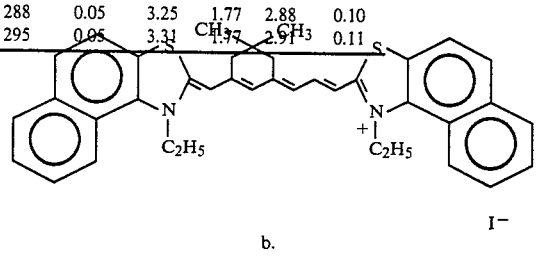

b.

TABLE III

| Ex | PMT | DBS | BCF | PEA | Dmin | Dmax | S | $\bar{C}$ | dS | % dS | Incubated Dmin | Dmax | S | $\bar{C}$ | −dS |
|---|---|---|---|---|---|---|---|---|---|---|---|---|---|---|---|
| 41 | 0 | 0 | 0 | 0 | 0.04 | 3.67 | 1.32 | 2.38 | — | 100 | 0.04 | 3.55 | 1.30 | 2.25 | 0.02 |
| 42 | 0.038 | 0 | 0 | 0 | 0.04 | 3.90 | 1.58 | 2.41 | 0.26 | 182 | 0.04 | 3.74 | 1.52 | 2.26 | 0.06 |
| 43 | 0 | 0.28 | 0 | 0 | 0.03 | 3.59 | 1.40 | 2.04 | 0.08 | 120 | 0.04 | 3.47 | 1.35 | 1.99 | 0.05 |
| 44 | 0 | 0 | 0.50 | 0 | 0.04 | 3.88 | 1.57 | 2.37 | 0.25 | 179 | 0.04 | 3.67 | 1.50 | 2.30 | 0.07 |
| 45 | 0 | 0 | 0 | 30 | 0.04 | 3.59 | 1.37 | 2.41 | 0.05 | 112 | 0.04 | 3.43 | 1.35 | 2.28 | 0.02 |
| 46 | 0.038 | 0.28 | 0 | 0 | 0.03 | 3.64 | 1.45 | 2.03 | 0.13 | 135 | 0.04 | 3.54 | 1.42 | 2.04 | 0.03 |
| 47 | 0.038 | 0 | 0.50 | 0 | 0.04 | 3.88 | 1.62 | 2.39 | 0.30 | 200 | 0.04 | 3.73 | 1.54 | 2.21 | 0.08 |
| 48 | 0.038 | 0 | 0 | 30 | 0.04 | 3.84 | 1.58 | 2.51 | 0.26 | 182 | 0.04 | 3.50 | 1.55 | 2.37 | 0.03 |
| 49 | 0 | 0.28 | 0.50 | 0 | 0.04 | 3.82 | 1.64 | 2.11 | 0.32 | 209 | 0.04 | 3.71 | 1.57 | 2.00 | 0.07 |
| 50 | 0 | 0.28 | 0 | 30 | 0.03 | 3.69 | 1.54 | 2.05 | 0.22 | 166 | 0.03 | 3.47 | 1.50 | 1.97 | 0.04 |
| 51 | 0 | 0 | 0.50 | 30 | 0.04 | 3.92 | 1.73 | 2.44 | 0.41 | 257 | 0.04 | 3.63 | 1.65 | 2.16 | 0.08 |
| 52 | 0.038 | 0.28 | 0.50 | 0 | 0.04 | 3.73 | 1.59 | 2.05 | 0.27 | 186 | 0.04 | 3.67 | 1.53 | 2.02 | 0.06 |
| 53 | 0.038 | 0.28 | 0 | 30 | 0.03 | 3.67 | 1.57 | 2.06 | 0.25 | 179 | 0.03 | 3.49 | 1.50 | 1.94 | 0.07 |
| 54 | 0.038 | 0 | 0.50 | 30 | 0.04 | 3.85 | 1.77 | 2.36 | 0.45 | 282 | 0.04 | 3.66 | 1.70 | 2.25 | 0.07 |
| 55 | 0 | 0.28 | 0.50 | 30 | 0.03 | 3.68 | 1.70 | 2.01 | 0.38 | 240 | 0.03 | 3.54 | 1.64 | 1.92 | 0.06 |
| 56 | 0.038 | 0.28 | 0.50 | 30 | 0.03 | 3.68 | 1.66 | 2.01 | 0.34 | 219 | 0.03 | 3.52 | 1.62 | 1.93 | 0.04 |
| 57 | 0.019 | 0.14 | 0.25 | 15 | 0.03 | 3.84 | 1.66 | 2.17 | 0.34 | 219 | 0.04 | 3.64 | 1.60 | 2.09 | 0.06 |
| 58 | 0.019 | 0.14 | 0.25 | 15 | 0.03 | 3.82 | 1.66 | 2.16 | 0.34 | 219 | 0.04 | 3.65 | 1.60 | 2.10 | 0.06 |
| 59 | 0.019 | 0.14 | 0.25 | 15 | 0.03 | 3.79 | 1.64 | 2.15 | 0.32 | 209 | 0.03 | 3.58 | 1.57 | 2.06 | 0.07 |
| 60 | 0.019 | 0.14 | 0.25 | 15 | 0.03 | 3.80 | 1.63 | 2.16 | 0.31 | 204 | 0.03 | 3.68 | 1.59 | 2.12 | 0.04 |

-continued

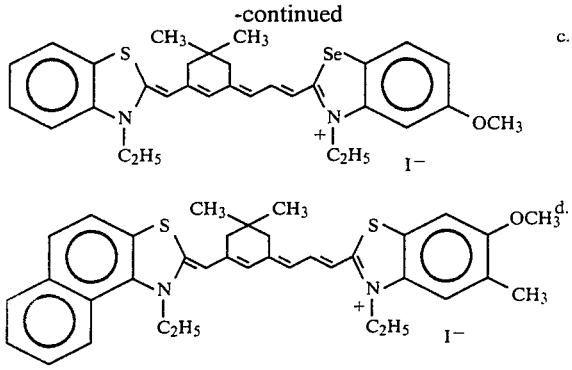

The results are reported in Table IV for fresh samples exposed at $10^{-3}$ seconds through an 810 nm, narrow band filters. The speed values at O.D.=1.0 ($S_1$) and O.D.=0.25 ($S_2$) were measured.

TABLE IV

| Ex. | Dye | Add. | Dmin | Dmax | $S_1$ | $S_2$ | $\bar{C}$ |
|---|---|---|---|---|---|---|---|
| 61 | a | — | 0.03 | 3.49 | 2.26 | 1.94 | 3.00 |
| 62 | a | DBS | 0.03 | 3.31 | 2.40 | 2.03 | 2.54 |
| 63 | b | — | 0.04 | 3.27 | 1.84 | 1.51 | 2.87 |
| 64 | b | DBS | 0.04 | 3.13 | 1.96 | 1.61 | 2.69 |
| 65 | c | — | 0.03 | 3.33 | 1.79 | 1.48 | 3.02 |
| 66 | c | DBS | 0.03 | 3.32 | 2.10 | 1.74 | 2.49 |
| 67 | d | — | 0.03 | 3.24 | 1.62 | 1.27 | 2.81 |
| 68 | d | DBS | 0.03 | 3.18 | 1.75 | 1.37 | 2.53 |
| 69 | I | DBS | 0.03 | 3.31 | 2.63 | 2.26 | 2.58 |

EXAMPLE 70

The addition of the following compounds in the same manner as the sodium diphenylphosphinobenzene-m-sulfonate of earlier examples also will show varying supersensitizing effects:

2-(diphenylamino)benzoic acid
4-(diphenylphosphino)benzoic acid
4-(diphenylarsino)benzoic acid
Trisodium salt of tri-(m-sulfophenyl)arsine
p-Diphenylbismuthinestris-sulfonic acid trisodium salt.

EXAMPLES 71-78

Preparation of Emulsion B

Silver halide light sensitive Emulsion B was prepared by precipitation and ripening steps using 98.0 mole percent silver bromide and 2.0 mole percent silver iodide in the presence of 15 g gelatin per mole of silver halide. The precipitated silver halide was freed of unwanted soluble by-product salts by coagulation and washing using the method disclosed in U.S. Pat. No. 2,489,341 wherein the silver halide and most of the gelatin were coagulated by sodium lauryl sulfate, using an acid coagulation environment. Following the washing step, the emulsion coagulum was redispersed in water together with 67 g of additional gelatin. This redispersed emulsion was treated with conventional sulfur and gold sensitizers and was digested at 55° C. to increase sensitivity, was cooled to 40° C., and was then treated with post sensitization additives and stabilizers, namely tetraazainidines, additional halides, and conventioal antifoggants, etc., as required and as is known in the art. The emulsion was coated to provide a silver coating weight in the range of 5.5 to 7.0 g/m$^2$.

Emulsion B was divided into two portions. To the first portion was added PEA and varying amounts of DBS (Table V). The coated and dried material was evaluated with a 1/10 second exposure from a tungsten light source with a color temperature of 2650° K. The light was filtered with a Corning 5850 blue filter. The exposed films were developed in a 90 second X-ray processor, and the results are listed in Table V.

TABLE V

| | | | Blue Filter | | | |
|---|---|---|---|---|---|---|
| Ex. | PEA | DBS | $D_{min}$ | $D_{max}$ | $SPD_2$ | AVCO |
| 71 | 25 | 0 | 0.18 | 3.19 | 1.96 | 3.10 |
| 72 | 25 | 0.014 | 0.19 | 3.09 | 1.98 | 3.01 |
| 73 | 25 | 0.035 | 0.19 | 3.16 | 2.03 | 3.04 |
| 74 | 25 | 0.070 | 0.19 | 3.26 | 2.06 | 3.01 |

The data verifies that DBS acts as a supersensitizer without the addition of spectral sensitizing dyes.

The second portion of Emulsion B was treated in the same manner as in Examples 71-74 with the exception that a green sensitizing dye (shown below) was added.

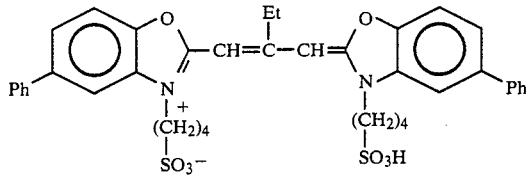

The films were evaluated as in Examples 71-74. In addition, a green filter system was substituted for the blue filter. The green filter was a narrow band interference filter centered at 546.1 nm. The results are shown in Table VI.

TABLE VI

| | | | Blue Filter | | | | Green Filter | | | |
|---|---|---|---|---|---|---|---|---|---|---|
| Ex | PEA | DBS | $D_{min}$ | $D_{max}$ | $SPD_2$ | AVCO | $D_{min}$ | $D_{max}$ | $SPD_2$ | AVCO |
| 5 | 25 | 0 | 0.19 | 3.54 | 1.96 | 3.08 | 0.19 | 3.49 | 2.02 | 3.09 |
| 6 | 25 | 0.007 | 0.19 | 3.59 | 1.99 | 3.12 | 0.19 | 3.52 | 2.04 | 3.09 |
| 7 | 25 | 0.035 | 0.19 | 3.55 | 2.02 | 3.07 | 0.19 | 3.52 | 2.08 | 3.06 |
| 8 | 25 | 0.140 | 0.22 | 3.54 | 2.10 | 2.94 | 0.22 | 3.52 | 2.12 | 2.94 |

The data shows that speed was increased by DBS in both the blue and green regions of the spectrum.

It is surprising in the practice of the present invention that the sensitizing/supersentizing compounds of the present invention perform at far more efficient rates and increase speed more in the infrared portions of the electromagnetic spectrum. There is at present no explanation for this phenonomenon.

The dyes of choice for sensitizing the silver halide emulsions to the infrared are benzothiazole-containing tricarbocyanines. The preferred compounds of this class have the common central structure of

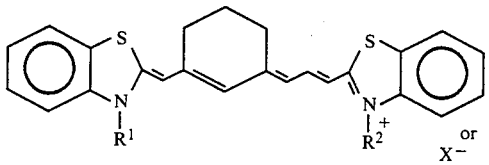

or

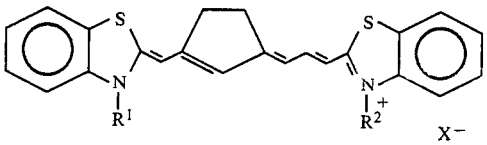

where $R^1$ and $R^2$ are alkyl of 1 to 4 carbon atoms and $X^-$ is any anion. The benzo groups may bear any photographically acceptible substituents, such as for example, alkyl (e.g., methyl, ethyl, propyl, butyl), alkoxy (e.g. methoxy, ethoxy, propoxy, butoxy), halogen (e.g., chlorine, bromine, iodine), amine (primary, secondary, tertiary aliphatic or aromatic amines), nitro, cyano, aryl (e.g. phenyl, naphthyl), fused on aromatic rings (e.g., to form naphthothiazoles), and mixtures of these groups. For example, 5-alkyl-6-alkoxy-, 5,6-dialkyl-, 5-alkoxy-6-alkyl, and 5,6-dialkoxy-benzothiazole terminal groups are preferred, particularly with $C_1$–$C_4$ alkyl and alkoxy groups, and 5-methyl-6-methoxy is most preferred.

I claim:

1. A silver halide photographic emulsion in a hydrophilic colloidal binder, said emulsion being spectrally sensitized by a spectral sensitizing dye to at least a portion of the electromagnetic spectrum and having a supersensitizing amount of a water-soluble triaryl compound selected from the group consisting of phosphines, amines, arsines, bismuthines and stibylidynes.

2. The emulsion of claim 1 wherein at least one aryl group on said compounds has a water-solubilizing group selected from the class consisting of sulfonic acid, sulfonate, sulfonic acid salt, phosphate, phosphinate, carboxylic acid, carboxylic acid salt, carboxylate, alcohol, nitro-, and amine.

3. The emulsion of claim 1 wherein said compound is represented by the structural formula

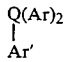

wherein

Q is selected from N, P, As, Sb and Bi,

Ar is an aryl group, and

Ar′ is an aryl group bearing at least one substituent which renders said compound water-soluble.

4. The emulsion of claim 1 wherein Ar and Ar′ are selected from phenyl groups.

5. The emulsion of claim 1 wherein at least one water-solubilizing substituent on Ar′ is selected from the group consisting of sulfonic acid, sulfonic acid salt, sulfonate, carboxylic acid, carboxylic acid salt, carboxylate, phosphate, phosphonate, alcohol, nitro- and amine.

6. The emulsion of claim 3 wherein the at least one water-solubilizing group on Ar′ is selected from the group consisting of sulfonic acid, sulfonic acid salt, sulfonate, carboxylic acid, carboxylic acid salt and carboxylate.

7. The emulsion of claim 1 further comprising a supersensitizing amount of poly(ethylacrylate).

8. The emulsion of claim 4 further comprising a supersensitizing amount of poly(ethylacrylate).

9. The emulsion of claim 6 further comprising a supersensitizing amount of poly(ethylacrylate).

10. The emulsion of claim 1 further comprising a supersensitizing amount of phenylmercaptotetrazole.

11. The emulsion of claim 8 further comprising a supersensitizing amount of phenylmercaptotetrazole.

12. The emulsion of claim 9 further comprising a supersensitizing amount of phenylmercaptotetrazole.

13. The emulsion of claim 1 further comprising a supersensitizing amount of Leucophor BCF.

14. The emulsion of claim 4 further comprising a supersensitizing amount of Leucophor BCF.

15. The emulsion of claim 12 further comprising a supersensitizing amount of Leucophor BCF.

16. The emulsion of claim 6 wherein Ar and Ar′ comprise phenyl groups, and there is present in the emulsion a supersensitizing amount of at least one compound selected from the group consisting of phenylmercaptotetrazole, poly(ethylacrylate), and Leucophor BCF.

17. The emulsion of claim 6 wherein Ar and Ar′ comprise phenyl groups and Q is selected from the group consisting of P and As.

18. The emulsion of claim 17 wherein Q is P.

19. The emulsion of claim 4 wherein Q is P and the emulsion is spectrally sensitized to the infrared region of the electromagnetic spectrum.

20. The emulsion of claim 18 wherien the emulsion is a chlorobromide emulsion.

21. A silver halide photographic emulsion in a hydrophilic colloidal binder, said emulsion being spectrally sensitized by a spectral sensitizing dye to at least a portion of the electromagnetic spectrum and having a supersensitizing amount of a water-soluble triaryl compound selected from the group consisting of amines, arsines, bismuthines and stibylidynes.

22. The emulsion of claim 21 wherein at least one aryl group on said compounds has a water-solubilizing group selected from the class consisting of sulfonic acid, sulfonate, sulfonic acid salt, phosphate, phosphinate, carboxylic acid, carboxylic acid salt, carboxylate, alcohol, nitro-, and amine.

23. The emulsion of claim 21 further comprising a super-sensitizing amount of poly(ethylacrylate).

24. The emulsion of claim 21 further comprising a super-sensitizing amount of phenylmercaptotetrazole.

25. The emulsion of claim 21 further comprising a super-sensitizing amount of Leucophor BCF.

* * * * *